US010038243B2

(12) United States Patent
Collignon

(10) Patent No.: US 10,038,243 B2
(45) Date of Patent: Jul. 31, 2018

(54) FLAT ANTENNA FOR SATELLITE COMMUNICATION

(71) Applicant: INEO DEFENSE, Velizy-Villacoublay (FR)

(72) Inventor: Gérard Collignon, Orsay (FR)

(73) Assignee: INEO DEFENSE, Velizy-Villacoublay (FR)

( * ) Notice: Subject to any disclaimer, the term of this patent is extended or adjusted under 35 U.S.C. 154(b) by 58 days.

(21) Appl. No.: 15/314,083

(22) PCT Filed: Jun. 8, 2015

(86) PCT No.: PCT/EP2015/062681
§ 371 (c)(1),
(2) Date: Nov. 27, 2016

(87) PCT Pub. No.: WO2015/189134
PCT Pub. Date: Dec. 17, 2015

(65) Prior Publication Data

US 2017/0187114 A1 Jun. 29, 2017

(30) Foreign Application Priority Data

Jun. 13, 2014 (FR) ..... 14 55391

(51) Int. Cl.
*H01Q 9/04* (2006.01)
*H01Q 1/28* (2006.01)
*H01Q 15/14* (2006.01)

(52) U.S. Cl.
CPC ..... *H01Q 9/0407* (2013.01); *H01Q 1/288* (2013.01); *H01Q 15/14* (2013.01)

(58) Field of Classification Search
CPC ..... H01Q 9/0407; H01Q 1/288; H01Q 15/14
See application file for complete search history.

(56) References Cited

U.S. PATENT DOCUMENTS

| | | | |
|---|---|---|---|
| 3,170,158 | A | 2/1965 | Rotman |
| 5,398,035 | A | 3/1995 | Densmore et al. |
| 8,284,102 | B2 | 10/2012 | Hayes et al. |
| 2011/0156948 | A1 | 6/2011 | Berejik |

*Primary Examiner* — Graham Smith
(74) *Attorney, Agent, or Firm* — Im IP Law; C. Andrew Im

(57) ABSTRACT

A flat antenna for satellite communication includes a radiating board. The radiating board includes at least one radiating line, and an adapter configured to modify the delay of the fields transmitted or received by the radiating line. The adapter includes a horn mobile in rotation between the two metal plates containing a sensor array. The horn is also mobile in rotation between at least one coaxial cable connected between at least one sensor of the network and the radiating line. The length of the coaxial cable is suitable for introducing a delay required to focus the wave radiated by the radiating line.

12 Claims, 2 Drawing Sheets

FLAT ANTENNA FOR SATELLITE COMMUNICATION

RELATED APPLICATIONS

This application is a § 371 application from PCT/EP2015/062681 filed Jun. 8, 2015, which claims priority from French Patent Application No. 14 55391 filed Jun. 13, 2014, each of which is incorporated herein by reference in its entirety.

FIELD OF THE INVENTION

The present invention pertains to the field of flat antennas for satellite telecommunications. The invention is particularly adapted for aircraft.

The invention finds a particularly advantageous application for sending and receiving data to or from a satellite in particular for satellite telecommunications of Satcom type (acronym of "Satellite communication").

BACKGROUND OF THE INVENTION

For certain telecommunications applications, in particular airborne applications, it is necessary to use flat antennas of very small thickness so as not to modify the aerodynamic profile of the carrier, for example when the antenna is positioned on the surface of an aircraft.

These telecommunication antennas comprise a plane surface comprising at least one radiating line able to transmit and receive signals of a frequency determined as a function of the shape of the radiating line. The signals are sent and received in the direction of the satellite which may be skewed with respect to the normal direction of the antenna as a function of the movements of the carrier. More specifically, these antennas must point a very directional beam inside a cone with a half-angle of at least 60° so that the antenna gain remains sufficient to guarantee the signal-to-noise ratio necessary for the quality of the link.

A known solution for carrying out this pointing consists in using a flat antenna 100 such as described in FIG. 1. This flat antenna 100 extends in a plane xy on an external wall 101 of an aircraft. Radiating lines 102 of the flat antenna 100 send and receive signals in a direction 103 skewed by an angle α with respect to the direction z normal to the surface of the flat antenna 100 in the plane perpendicular to the radiating lines 102 (xoz). This skewing requires an adjustment of the phase on each radiating line by means for example of programmable electronic phase shifters. The phase $\varphi_i$ to be displayed on line i so as to obtain a pointing in the direction a is given by the expression:

$$\varphi_i = 2\pi\, id \sin \alpha/\lambda;$$

with: i corresponding to the index of the line, d to the spacing between the lines and λ to the wavelength.

In order to skew the signals received in a cone, the flat antenna 100 is moreover movable in rotation β about an axis z orthonormal with the axes xy.

This first solution makes it possible to electronically scan all the pointing directions inside the cone.

However, the direction of the pointing in terms of a varies with the wavelength λ and does not allow simultaneous operation in two very different frequency bands such as in the Satcom Ka band for example (20 GHz when receiving, 30 GHz when sending).

To remedy this problem, it is known to use a ROTMAN lens described, for example, in U.S. Pat. No. 3,170,158. The ROTMAN lens is a known device making it possible customarily to obtain an antenna that radiates several beams that are skewed in a plane. The lens is furnished with N accessways each giving a beam in a frequency-independent given direction. Angular scanning is obtained by switching between the N available beams.

The lens is formed by the space between two parallel conducting planes, the input array consists of fixed horns embodied in waveguide form and radiating a polarization perpendicular to the metallic planes. The output array can consist of monopole type elements perpendicular to the metallic planes and making it possible to tap off the energy radiated by the horns of the input array. The linear array of radiating elements is fed by way of links (coaxial for example) whose lengths are such that the radiated wave is plane.

According to a similar principle, U.S. Pat. No. 8,284,102, discloses an electronic phase shifter comprising an electronic selector for a linear or curved array of sources. The focusing of the antenna is carried out by internal reflector elements and means of dielectric or refractive focusing.

This second solution makes it possible to have a fixed flat antenna on the surface of an aircraft. However, this solution limits the number of directions in which the antenna can be pointed as a function of the number of sources. Moreover, the installation of a linear array of sources and means of electronic selection increases the bulkiness of the flat antenna.

OBJECT AND SUMMARY OF THE INVENTION

The present invention intends to remedy the drawbacks of the prior art by proposing a fixed flat antenna furnished with a horn that is movable so as to continuously scan all directions.

For this purpose, the present invention relates to a flat antenna for satellite telecommunication comprising a radiating board comprising at least one radiating line, and an adaptation means able to modify the delay of the fields emitted or received by the at least one radiating line, said adaptation means comprising a horn movable in rotation between two metallic plates containing an array of sensors, and at least one coaxial cable connected between at least one sensor of the array and the at least one radiating line, the length of the at least one coaxial cable being adapted so as to introduce a delay required for focusing the wave radiated by the radiating board.

Thus, the invention makes it possible to continuously scan all directions associated with each position of the movable horn. The invention makes it possible to fix the antenna on a plane surface, thus limiting the fragility of the antenna and improving the aerodynamic shape of the carrier of the antenna.

This antenna structure operates in a very broad frequency band since it provides frequency-independent pointing.

According to one embodiment, the horn is able to transmit between the metallic plates a wave whose electric field is perpendicular to the metallic plates.

According to one embodiment, said adaptation means also comprises an array of sensor monopoles fixed on at least one metallic plate, the at least one coaxial cable being connected between said array of sensor monopoles and the at least one radiating line. The sensor monopoles are connected as an array and are able to tap off the energy emitted by the horn at a spacing of less than ½ of a wavelength. The array of sensor monopoles may consist of metallic single strands (monopoles) or of slots or of any other type of elementary antenna. This embodiment thus makes it possible to transmit the energy captured by the horn to the radiating lines.

According to one embodiment, said array of sensor monopoles comprises a surface closed by a metallic reflector. The metallic reflector makes it possible to limit the radiation of the array of monopoles on the horn side.

According to one embodiment, said metallic reflector is positioned ¼ of a wavelength to the rear of the sensor monopoles.

According to one embodiment, the length of the at least one coaxial cable is adapted to introduce an additional delay making it possible to obtain an initial fixed pointing in such a way that the total pointing varies from 0° to 60° for a symmetric displacement of the horn of about ±30°. This embodiment, associated with the 360° global rotation of the antenna about its axis z, makes it possible to contain all the directions in a cone of half-angle 60° centered on the direction normal to the antenna.

According to one embodiment, the two metallic plates are fixed on a plane parallel to the plane of said radiating board.

According to one embodiment, said radiating board comprises several radiating lines spaced apart by about half a wavelength. This embodiment makes it possible in particular to avoid problems related to array lobes.

According to one embodiment, said radiating board comprises several radiating lines consisting of an alignment of radiating elements such as dipoles, patches or slots.

According to one embodiment, said radiating board comprises several radiating lines each comprising a distributor with one input and several outputs corresponding to the number of radiating elements of the radiating line.

BRIEF DESCRIPTION OF THE DRAWINGS

The invention will be better understood with the aid of the description, given hereinafter purely by way of explanation, of the embodiments of the invention, with reference to the figures in which.

DETAILED DESCRIPTION OF THE EMBODIMENTS OF THE INVENTION

Figure 1:
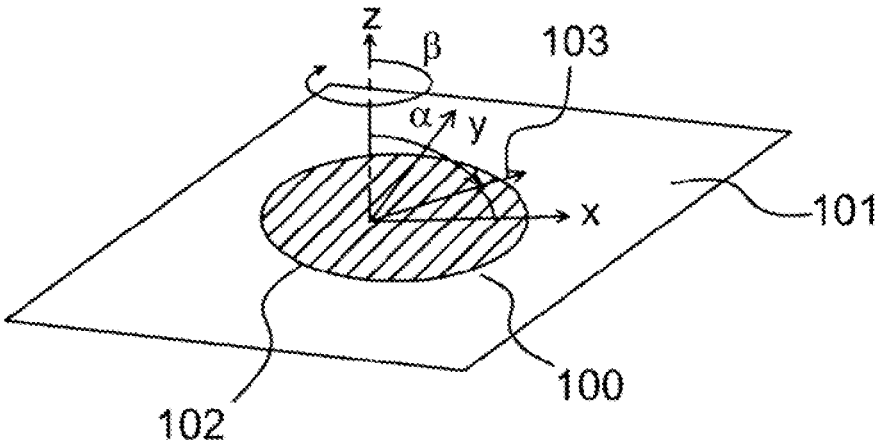
PRIOR ART Fig.1
FIG. 1 illustrates a flat and movable satellite telecommunications antenna according to the prior art.
Figure 2:
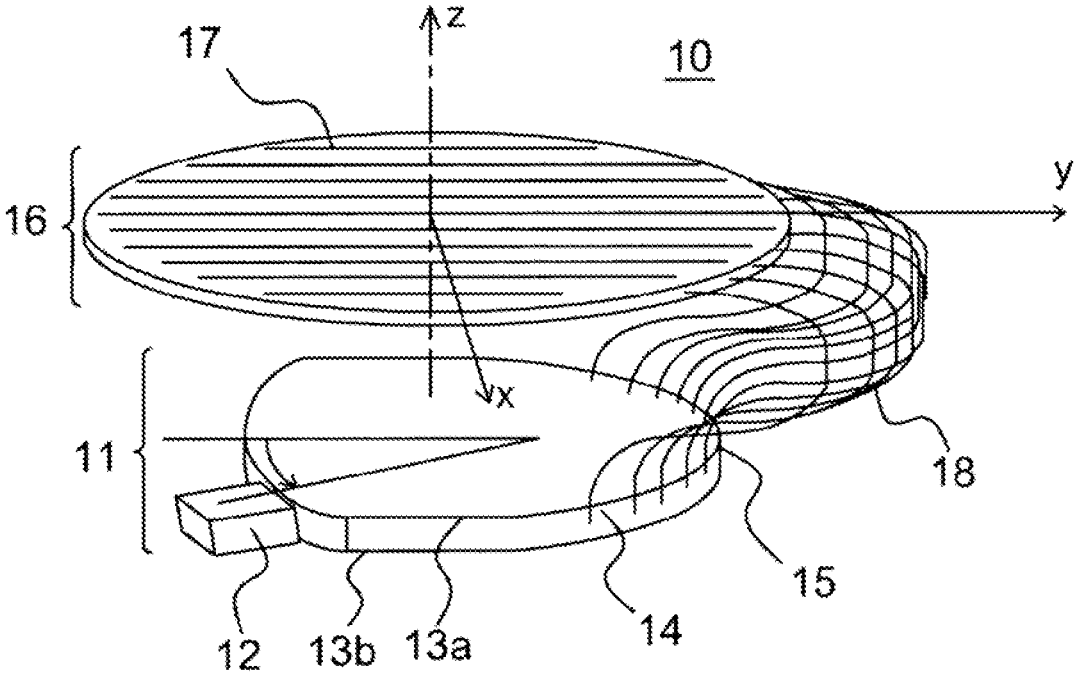
FIG. 2 illustrates a flat satellite telecommunications antenna according to an embodiment of the invention.

FIG. 2 reveals a flat satellite telecommunications antenna 10 consisting of a radiating board 16 linked to an adaptation means 11 able to modify the delays of the fields emitted or received by the radiating board 16.

The radiating board 16 extends in a plane xy and comprises several radiating lines 17 disposed along the axis y at a spacing of about half a wavelength along the axis x. Each radiating line 17 consists of an alignment of N radiating elements (not represented), for example dipoles, patches or slots disposed at a spacing of less than a wavelength along the y axis and fed by a distributor comprising one input and N outputs.

Figure 3:
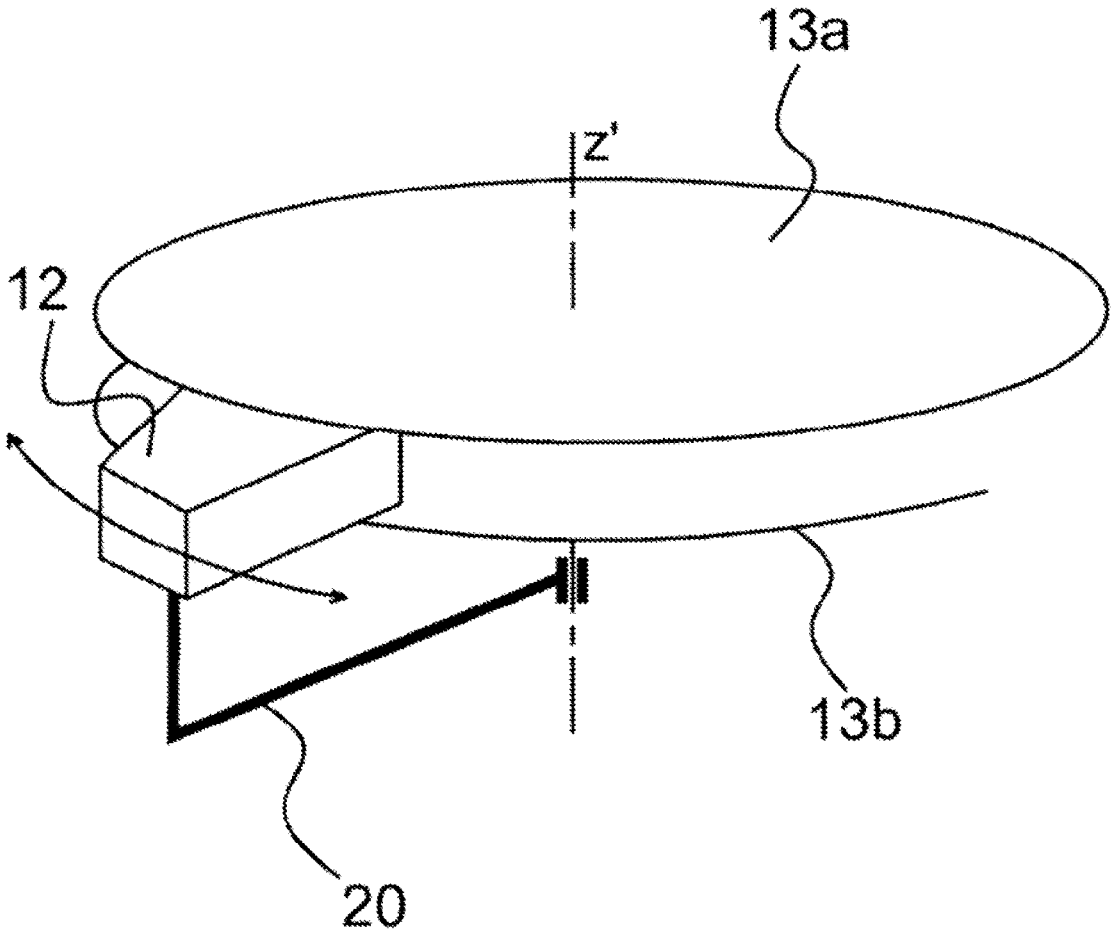
FIG. 3 illustrates the movable horn of the antenna of FIG. 2.

The adaptation means 11 consists of a horn 12 movable in rotation between two metallic plates 13*a* and 13*b* parallel to the radiating board 16. The horn 12, represented in FIG. 3, is movable in rotation about the axis z' (parallel to or coincident with the axis z) extending in a direction normal to the plane xy. The mobility of the horn 12 is ensured by a numerically controlled guide 20.

The horn 12 radiates between the two metallic plates 13*a*, 13*b* a TEM (for transverse electric-magnetic) wave whose electric field is perpendicular to the metallic plates 13*a*, 13*b*. An array of monopoles 14 is fixed on the upper metallic plate 13*a* in order to capture the TEM wave. The rear of the array of monopoles 14 is closed by a metallic reflector 15 situated at about ¼ of a wavelength in order to close the adaptation means.

Each monopole of the array 14 is connected to each radiating line 17 of the radiating board 16 by way of a coaxial cable 18. The coaxial cables 18 are all of different lengths and introduce the delay required for focusing wave radiated by the radiating board 16. They also introduce an additional delay making it possible to obtain an initial fixed pointing in such a way that the total pointing varies from 0° to 60° for a symmetric displacement of the horn.

The invention thus makes it possible to point in all the directions contained in the cone of half-angle 60° centered on the axis z by rotating the horn 12 by around ±30° about the axis z' and by rotating the antenna assembly by 360° about the axis z. This antenna structure operates in a very broad band of frequencies since the movable horn 12 makes it possible to obtain frequency-independent pointing.

The invention claimed is:

1. A flat antenna for satellite telecommunication, comprising:

a radiating board comprising at least one radiating line; and an adapter configured to modify a delay of fields emitted or received by said at least one radiating line, the adapter comprises:

a horn movable in rotation between two metallic plates comprising an array of sensors, and between at least one sensor of the array and said at least one radiating line; and a length of said at least one coaxial cable is configured to introduce a delay required to focus a wave radiated by said at least one radiating line.

2. The flat antenna as claimed in claim 1, wherein the horn transmits the wave between the two metallic plates, an electric field of the wave is perpendicular to the metallic plates.

3. The flat antenna as claimed in claim 2, wherein the adapter further comprises an array of sensor monopoles fixed on at least one metallic plate; and wherein said at least one coaxial cable is connected between the array of sensor monopoles and said at least one radiating line.

4. The flat antenna as claimed in claim 1, wherein the adapter further comprises an array of sensor monopoles fixed on at least one metallic plate; and wherein said at least one coaxial cable is connected between the array of sensor monopoles and said at least one radiating line.

5. The flat antenna as claimed in claim 4, wherein the array of sensor monopoles comprises a surface closed by a metallic reflector.

6. The flat antenna as claimed in claim 5, wherein the metallic reflector is positioned at ¼ of a wavelength from the array of sensor monopoles.

7. The flat antenna as claimed in claim 1, wherein the length of said at least one coaxial cable is configured to introduce an additional delay to obtain an initial fixed pointing such that a total pointing varies from 0° to 60° for a symmetric displacement of the horn.

8. The flat antenna as claimed in claim 1, wherein the two metallic plates are fixed on a plane parallel to a plane of the radiating board.

9. The flat antenna as claimed in claim 1, wherein the radiating board comprises a plurality of radiating lines spaced apart by a half of a wavelength.

10. The flat antenna as claimed in claim 1, wherein the radiating board comprises a plurality of radiating lines comprising an alignment of radiating elements.

11. The flat antenna as claimed in claim 10, wherein the radiating elements are dipoles, patches or slots.

12. The flat antenna as claimed in claim 10, wherein each radiating line comprises a distributor with one input and a plurality of outputs corresponding to a number of the radiating elements of said each radiating line.

* * * * *